US011651867B2

(12) United States Patent
Mahosky

(10) Patent No.: US 11,651,867 B2
(45) Date of Patent: May 16, 2023

(54) METHOD FOR REDUCING RADIOLOGICALLY-CONTAMINATED WASTE

(71) Applicant: Westinghouse Electric Company LLC, Cranberry Township, PA (US)

(72) Inventor: Keith Mahosky, Jeannette, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 419 days.

(21) Appl. No.: 16/871,703

(22) Filed: May 11, 2020

(65) Prior Publication Data

US 2021/0350945 A1 Nov. 11, 2021

(51) Int. Cl.

| | |
|---|---|
| ***G21F 9/00*** | (2006.01) |
| ***B07C 5/346*** | (2006.01) |
| ***G21F 9/14*** | (2006.01) |
| ***G21F 9/16*** | (2006.01) |
| ***G21F 9/30*** | (2006.01) |
| ***G21F 9/32*** | (2006.01) |

(52) U.S. Cl.

CPC ..... *G21F 9/002* (2013.01); *B07C 5/346* (2013.01); *G21F 9/14* (2013.01); *G21F 9/165* (2013.01); *G21F 9/304* (2013.01); *G21F 9/32* (2013.01); *B07C 2501/0054* (2013.01)

(58) Field of Classification Search

CPC ... G21F 9/00; G21F 9/002; G21F 9/14; G21F 9/165; G21F 9/304; G21F 9/32; B07C 5/346; B07C 2501/0054

USPC ..... 588/3

See application file for complete search history.

(56) References Cited

U.S. PATENT DOCUMENTS

| | | | |
|---|---|---|---|
| 6,147,274 | A | 11/2000 | Wood et al. |
| 6,447,366 | B1 | 9/2002 | Ebadian et al. |
| 2013/0296628 | A1 | 11/2013 | Cho et al. |

FOREIGN PATENT DOCUMENTS

| | | | |
|---|---|---|---|
| EP | 0174797 | A2 | 3/1986 |
| JP | 2014137253 | A | 7/2014 |
| WO | 0078403 | A1 | 12/2000 |
| WO | 0211152 | A2 | 2/2002 |
| WO | 2021231401 | A1 | 11/2021 |

OTHER PUBLICATIONS

International Search Report and Written Opinion for International PCT Application No. PCT/US2021/031746, dated Oct. 29, 2021.

Search Report for corresponding Taiwan Application No. 110116893, dated Jul. 25, 2022.

*Primary Examiner* — Edward M Johnson

(74) *Attorney, Agent, or Firm* — K&L Gates LLP

(57) ABSTRACT

A method for reducing radiologically-contaminated waste is provided. The method comprises treating radiologically-contaminated surfaces and subsurfaces. The method comprises consolidating soil waste. The method comprises employing real-time scanning technology to classify waste based at least in part on a threshold of radiological contamination. The waste is sorted based on the classification. The waste is disposed of via at least one of different disposal routes, based at least in part on the classification.

18 Claims, 2 Drawing Sheets

METHOD FOR REDUCING RADIOLOGICALLY-CONTAMINATED WASTE

BACKGROUND

Nuclear facilities where radioactive materials are used and researched (e.g., nuclear power plants, research installations, national defense installations, and the like) may generate radiologically-contaminated waste. For example, radiologically-contaminated waste may be generated during operation or maintenance of a nuclear reactor or during disassembly of nuclear facilities and/or components thereof. Disposal of radiologically-contaminated waste is a major responsibility and expense related to operation and clean-up of nuclear facilities.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, abstract and drawings as a whole.

Provided herein is a method for reducing radiologically-contaminated waste. The method comprises treating radiologically-contaminated surfaces, wherein the radiologically-contaminated surfaces are treated with a surface treatment agent; treating radiologically-contaminated subsurfaces, wherein the radiologically-contaminated subsurfaces are treated with a surface/subsurface treatment agent; consolidating soil waste; employing real-time scanning technology to classify waste, wherein the classifying is based at least in part on a threshold of radiological contamination, and wherein the classified waste is sorted based on the classification; and disposing of the waste via at least one of different disposal routes, based at least in part on the classification.

Also provided herein is a method for reducing radiologically-contaminated waste. The method comprises treating radiologically-contaminated surfaces, wherein the radiologically-contaminated surfaces are treated with a surface treatment agent; treating radiologically-contaminated subsurfaces, wherein the radiologically-contaminated subsurfaces are treated with a surface/subsurface treatment agent; consolidating soil waste; employing real-time scanning technology to classify waste, wherein the classifying is based at least in part on a threshold of radiological contamination, and wherein the classified waste is sorted based on the classification; and disposing of the waste via at least one of different disposal routes, based at least in part on the classification. The method results in a reduction of waste class comprising a reduction of radiologically-contaminated waste from a first contamination threshold to a second lower contamination threshold, and disposing of the reduced radiologically-contaminated waste comprises disposing via a disposal route that corresponds to the reduced waste class.

BRIEF DESCRIPTION OF THE DRAWINGS

Various features of the embodiments described herein are set forth with particularity in the appended claims. The various embodiments, however, both as to organization and methods of operation, together with advantages thereof, may be understood in accordance with the following description taken in conjunction with the accompanying drawings as follows:

Figure 1:
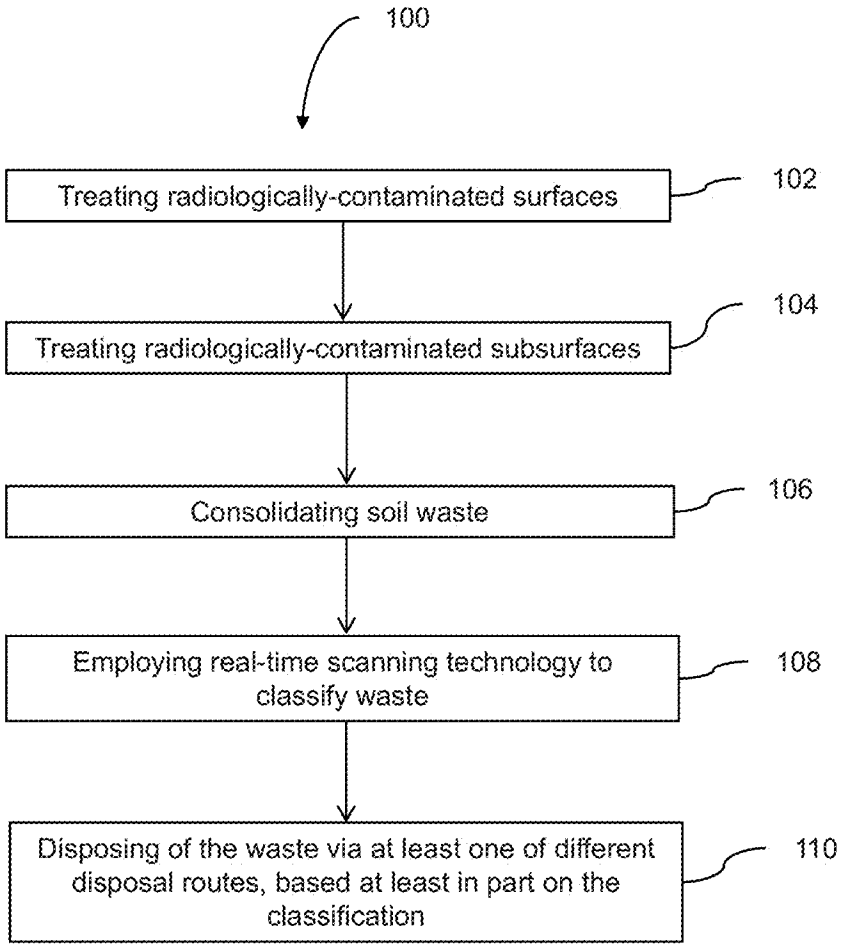
FIG. 1 is a flow chart showing a method of the present disclosure.

Corresponding reference characters indicate corresponding parts throughout the several views. The exemplifications set out herein illustrate various embodiments of the present disclosure, in one form, and such exemplifications are not to be construed as limiting the scope of the present disclosure in any manner.

DESCRIPTION

Before explaining various aspects of the present disclosure in detail, it should be noted that the illustrative examples are not limited in application or use to the details of construction and arrangement of parts illustrated in the accompanying drawings and description. The illustrative examples may be implemented or incorporated in other aspects, variations, and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following-described aspects, expressions of aspects, and/or examples, can be combined with any one or more of the other following-described aspects, expressions of aspects, and/or examples.

Nuclear facilities where radioactive materials are used and researched (e.g., nuclear power plants, research installations, national defense installations, and the like) may generate radiologically-contaminated waste. In addition to waste that is generated while the facility is in use or undergoing maintenance, waste may also accumulate during deactivation and decommissioning (D&D) of such facilities (e.g., contaminated concrete, contaminated operating systems and components, contaminated soil). As used herein, "D&D" refers to deactivation, decommissioning, decontamination, and other processes performed to allow nuclear facilities to cease operations and reduce or eliminate control of the site that is otherwise required due to the presence of radioactive materials. Elements of D&D and the classification of the resulting waste is regulated, for example, at the national level by the Department of Energy in the United States and internationally by the International Atomic Energy Agency (IAEA).

As used herein, "radiologically-contaminated waste," "waste," "radioactive waste," "D&D-associated waste," and the like are used interchangeably and refer to materials that are at least partially contaminated with radioactivity (via, for example, neutron activation and/or contact with nuclear fuel or decay products thereof). D&D processes may generate waste via, for example, removal of contaminated soil or treatment or deconstruction of contaminated structures. Alternatively or additionally, the waste may be pre-existing and disposed of during the D&D processes. The waste can be any material that is at least one of, treated, classified, and disposed of during D&D processes. The waste may be liquid or solid in nature.

Waste can be disposed of in specified and/or government-regulated manners in order to reduce or eliminate the hazard posed by the radiological contamination of the waste. The waste can be classified based on at least one of the physical nature of the waste (e.g., solid, liquid); the nature of the contamination (e.g., long- or short-lived radioactive isotopes); and a threshold (e.g., degree) of contamination (e.g., units of radioactivity per gram of waste).

Waste classification systems have been developed in order to aid in determining how a given waste product should be disposed of safely and effectively. For example, the United States Department of Energy has issued the regulations at Title 10, Chapter 1 of the C.F.R., part 61, subpart D (10 C.F.R. § 61.55 [47 FR 57463, Dec. 27, 1982, as amended at 54 FR 22583, May 25, 1989; 66 FR 55792, Nov. 2, 2001]). 10 C.F.R. § 61.55 [47 FR 57463, Dec. 27, 1982, as amended at 54 FR 22583, May 25, 1989; 66 FR 55792, Nov. 2, 2001] is incorporated herein by reference. These regulations set forth particular thresholds for the presence of radioactive isotopes in radiologically-contaminated waste. The combination and amount of isotopes present determine the waste classification. The waste classification can be, for example and in order of decreasing contamination and cost to dispose of, Class C, Class B, and Class A. In some examples, Class A waste can be further reduced to exempt waste.

As another example, the IAEA published the "Classification of Radioactive Waste, General Safety Guide No. GSG-1" in 2009, which is incorporated herein by reference. The document notes certain criteria for waste classifications which include, inter alia and in order of increasing contamination threshold and increasingly complex required disposal methods, "Exempt waste," "Very Low Level Waste (VLLW)," "Low Level Waste (LLW)," "Intermediate Level Waste," and "High Level Waste." The document further explains principles for classification of the waste.

In various aspects, a reduction of a given waste's classification (from more contaminated, to less contaminated) can allow for increased efficiency during disposal of the waste and/or reduced disposal costs. Additionally, a process for accomplishing this reduction has been discovered. The process comprises steps which have heretofore not been performed in a coordinated fashion and results in effective and efficient reduction of waste. Accordingly, disclosed herein is a method for reducing radiologically-contaminated waste. As used herein, "reducing radiologically-contaminated waste," "reducing waste," and the like mean reducing the classification of the waste (e.g., by treating the waste, by shredding the waste, by more particularly classifying the waste, and/or by other methods as disclosed herein). For example, an initial portion of waste consisting of Class B waste may be reduced to waste consisting of Class A waste or waste consisting of a mixture of Class B and Class A waste. Similarly LLW may be at least partially reduced to VLLW and/or exempt waste. Thus, the methods of the present disclosure are concerned with reducing the class of waste that is to be disposed of, irrespective of the precise method of classification which is used, which may vary over time and location.

Reducing radiologically-contaminated waste is beneficial during, for example, D&D processes because disposal of the waste, particularly more highly contaminated and therefore more highly classified waste, is expensive, time consuming, and only available at limited locations. Reducing the waste can allow for disposal of at least a portion of the waste via less expensive and/or more accessible disposal routes.

Referring to FIG. 1, a method 100 for reducing radiologically-contaminated waste can comprise treating 102 radiologically-contaminated surfaces; treating 104 radiologically-contaminated subsurfaces; consolidating 106 soil waste; employing 108 real-time scanning technology to classify waste; and disposing 110 of the waste via at least one of different disposal routes, based at least in part on the classification.

Performance of the method 100 and other exemplary methods disclosed herein can result in a reduction of radiologically-contaminated waste. The steps of the methods disclosed herein can be performed in any suitable order and can be designed to increase the reduction of waste that can be achieved. Additionally, the methods described herein allow for previously unattainable coordination between the various types and steps of waste disposal required by, for example, D&D processes at nuclear facilities. This coordination can further increase the reduction of waste. For example, the treatment and/or consolidation 102, 104, 106 of waste as described herein can be practiced alongside the classification and sorting of waste provided by the use 108 of real-time scanning technology. Thus, and for example, the treatment 102, 104 of waste can achieve a first reduction of waste (e.g., by removing radioactive contamination), and the real-time sorting of waste can achieve a second reduction of waste by separating treated waste that is below a contamination threshold from treated waste that is above a contamination threshold. The optional use of, for example, cementation, pyrolization, and/or incineration, can further enhance the reduction of treated Class B, Class C, and/or Intermediate Level Waste. Technical details and examples of the method 100 are discussed below.

Treatment 102 of radiologically-contaminated surfaces can comprise removing (e.g., by dissolving into a treatment fluid) radiological contamination from non-porous and/or metallic surfaces of the nuclear facility. Thus, a reduction of large, heavy waste products can be achieved. The treatment 102 can be used to decontaminate any suitable plant system and/or component (e.g., those of a nuclear reactor) which comprises materials chemically compatible with the surface treatment agent. Nuclear power plants such as PWR, BWR, and CANDU plants all comprise suitable plant systems and/or components. Exemplary plant systems include Reactor Recirculation (RRS), Reactor Water Cleanup (RWCU), Residual Heat Removal (RHR), Chemical Volume Control System (CVCS), and Primary Heat Transport System (PHTS). The treatment 102 of radiologically-contaminated surfaces can comprise utilizing a surface treatment agent to remove radioactivity-containing corrosion products from the internal surfaces of tubes, pipes, fluid vessels, and other similar equipment.

The surface treatment agent and use thereof can comprise multiple components and/or processes and may be applied in a single step or multiple steps. The treatment 102 can comprise treating plant systems and/or components while they remain assembled and/or while they are disassembled. Examples of the surface treatment agent include agents comprising oxidizing and reducing chemistries. The first surface treatment 102 can comprise utilizing one or more of the below surface treatment agents and can be performed in any suitable order. For example, reducing chemistries can comprise surface treatment agents such as LOMI and LOMI II (Low Oxidation-state Metal Ion), CITROX (a surface treatment comprising utilizing citric acid and oxalic acid), NITROX-E (a surface treatment comprising utilizing nitric acid, oxalic acid and potassium permanganate), CANDEREM (a surface treatment comprising utilizing EDTA (ethylenediaminetetraacetic acid), citric acid and ammonium hydroxide), and REMCON (a surface treatment comprising utilizing ascorbic acid, citric acid, ammonium hydroxide and a corrosion inhibitor). These surface treatments are available directly or indirectly from Westinghouse Electric Company, Cranberry Township, Butler County, Pa., U.S. Oxidizing chemistries that can be used as the surface treatment agent comprise Decontamination for Decommissioning (DFD) and DFDX (which comprise utilizing fluoroboric acid with oxalic acid and potassium permanganate); Nitric Acid Permanganate (NP) Alkaline Permanganate (AP) (which comprise utilizing potassium permanganate with nitric acid or sodium hydroxide); BiOX-2 (which comprises utilizing ascorbic acid, citric acid, and ammonium hydroxide along with a corrosion inhibitor and hydrogen Peroxide); and passivation (which comprises utilizing a solution of ammonium citrate). These surface treatments are available directly or indirectly from Westinghouse Electric Company, Cranberry Township, Butler County, Pa., U.S. Generally, an oxidizing chemistry will not be used in same time and location as a reducing chemistry due mutual incompatibility between the chemistries. Thus, if use of both is desired, the two chemistries can be used sequentially and/or in different locations.

It is understood that the surface treatment agent (and the treatment 102) may remove and/or decontaminate an outer layer of the system, component, and/or equipment that is being decontaminated. Some types of contamination (e.g., those caused by neutron activation or those located below the outer layer) may not be fully removed.

Equipment used to perform the treatment 102 may comprise equipment suitable to perform recirculation of the surface treatment chemical components through the contaminated equipment and/or systems. The treatment 102 may also be performed with only a single circulation equipment and/or systems. Reverse flow of the surface treatment agent through the equipment and/or systems may also be employed. Circulation of the surface treatment agent can be optimized based on the plant system and cleaning requirements. Suitable equipment used to perform the surface treatment 102 may comprise a pump skid, a chemical mix tank comprising an in-line heater, ion exchange columns, and tank systems for material immersion during treatment 102.

In addition to the treatment of plant systems and/or components while they are assembled and in place, the treatment 102 of radiologically contaminated surfaces using the surface treatment agent may also comprise disassembly of plant systems and/or components. If disassembly is employed, contaminated articles can be shredded (e.g., cut into pieces) and/or treated in a bath. Any suitable combination of treatment in place, disassembly, and/or shredding of plant systems and/or components can be used in order to increase the reduction of waste. Treatment in a bath allows for more targeted treatment of, for example, more highly contaminated surfaces and/or treatment of otherwise difficult-to-access components. For example, the surface treatment agent may be able to contact a given surface effectively only when components are disassembled. Similarly, shredding of components can also increase the effectiveness of the surface treatment 102. Shredding may also enable easier sorting of waste, based on waste class. For example, shredding can allow for avoidance of disposing of a large component as a higher waste class when only a portion of the component is contaminated. Thus, shredding of waste can be employed before treatment 102 to increase the effectiveness of the treatment, and/or shredding of waste can be employed after the waste is treated 102 to enhance the classification of waste during the classifying 108 step. The combination of surface treatment 102 with disassembly and/or shredding of components as disclosed herein allows for increased reduction of waste.

Treatment 104 of radiologically-contaminated subsurfaces can comprise removing (e.g., by dissolving into a treatment fluid) radiological contamination from subsurfaces which may contain contamination located at or below the surface of the material. Examples of such materials include concrete (e.g., cinder block, brick, and tile); glass; asphalt; transite (e.g., cement composites); and wood but may also comprise other materials in need of below-surface treatment. Treatment 102 of radiologically-contaminated surfaces can be performed separately from or concurrently with treatment 104 of subsurfaces. The treatment 102 of radiologically contaminated surfaces and the treatment 104 of radiologically-contaminated subsurfaces can be applied to the same waste (e.g., consecutive treatments 102,104) or to different waste.

Similarly to treatment 102 of radiologically-contaminated surfaces, treatment 104 of subsurfaces can also achieve a reduction of large, heavy waste products that would otherwise require more complex and expensive disposal.

The treatment 104 of subsurfaces can comprise utilizing a surface/subsurface treatment agent to dissolve and/or remove the radiological contamination. The surface treatment agent and the surface/subsurface treatment agent may comprise the same chemical species, different chemical species, or a mixture thereof. The surface/subsurface treatment agent can comprise multiple components and/or processes and may be applied together in a single step or in multiple steps. It is understood that the surface/subsurface treatment agent (and the treatment 104) may dissolve and/or remove radiological contamination from at least one of an outer surface of waste and subsurface locations of waste. Subsurface locations include, for example, internal voids of concrete and similar materials.

Examples of the surface/subsurface treatment agent include both liquids and gels that can be applied via atomized spraying or foam to the contaminated waste. The treatment 104 can be used to decontaminate any suitable plant material and/or component which comprises materials chemically compatible with the surface treatment agent. Nuclear facilities comprising radiologically-contaminated waste can comprise materials such as walls, ceilings, equipment, structural beams, internal piping, and irregular surfaces which can all benefit from the treatment 104 and contribute to reduction of waste. Exemplary surface/subsurface treatment agents include Rad-Release I and Rad-Release II which can comprise at least one of organic and inorganic acids, salt, surfactant, and chelator which can act together to promote the release and sequestration of contamination from porous surfaces and subsurfaces. Another exemplary surface/subsurface treatment agent comprises EAI SuperGel which comprises nanoparticles and a superabsorbent polymer gel. These components respond to a wetting agent and act to absorb and/or sequester radiological contamination away from the contaminated pores of the porous surface. Rad-Release I and II and EAI SuperGel are available from Environmental Alternatives, Inc., Swanzey, N.H., United States. After application, the surface/subsurface treatment agent can be rinsed away, dehydrated and vacuumed, or otherwise removed, along with sequestered radiological contaminants.

The surface treatment agent and the subsurface treatment agent can be applied via an automated or manual process. For example, handheld spray wands or similar devices may be used. Alternatively or additionally, larger (e.g., remotely controlled) spraying devices comprising multiple applicators may be used to allow fewer operators to apply treatment agent to a larger area. If higher levels of contamination are present, the treatment steps 102, 104 can be performed multiple times to increase overall waste reduction.

The treatment 104 of porous radiologically-contaminated materials using the surface/subsurface treatment agent may also comprise disassembly of materials and/or components. If disassembly is employed, contaminated materials and/or components can be shredded and/or treated in a bath. Similarly, contaminated materials and/or components may be crushed. Any suitable combination of treatment in place, disassembly, crushing, and/or shredding of materials and/or components can be used in order to increase the reduction of waste. Treatment in a bath allows for more targeted treatment of, for example, more highly contaminated materials and/or components and/or treatment of otherwise difficult-to-access materials and/or components. For example, the surface treatment agent may be able to contact a given component effectively only when components are disassembled. Similarly, shredding and/or crushing of components can also increase the effectiveness of the surface treatment 104. Shredding and/or crushing may also enable easier sorting of waste, based on waste class. For example, shredding and/or crushing can allow for avoidance of disposing of a large component as a higher waste class when only a portion of the component is contaminated. Thus, shredding and/or crushing of waste can be employed before treatment 104 to increase the effectiveness of the treatment, and/or shredding of waste can be employed after the waste is treated 104 to enhance the classification of waste during the classifying 108 step. The combination of surface treatment with disassembly, shredding, and/or crushing of components as disclosed herein allows for increased reduction of waste.

The method 100 can comprise cementing at least one of liquid and solid waste. For example, at least one of Class B, Class C, and Intermediate Level Waste can be cemented. Liquid waste can comprise, for example, waste generated by nuclear facility operations or waste generated by D&D processes such as the treatments 102, 104. If desired, solid waste (e.g., waste treated during treatments 102,104 or previously-accumulated waste) may also be cemented. Cementing waste can comprise adding the waste, water, and additives in to a metal drum (e.g., 200 or 400 Liters), surrounding and/or mixing the waste, water, and additives with cement and allowing the mixture to harden, thereby immobilizing the waste for subsequent disposal. Due to dilution, the cementing can further reduce the activity of the waste (per volume or mass) before disposal.

The method 100 can comprise characterizing levels of radiological contamination of waste before any of the treating 102, 104 and consolidating 106 steps. Characterizing levels of radiological contamination of waste can comprise utilizing at least one of a hand-held ion chamber survey meter, a hand-held Geiger counter, and a hand-held scintillation probe. Performing such characterizing before the treating 102, 104 and consolidating 106 steps can allow the subsequent steps to focus on areas most in need of treatment and consolidation. In turn, that focus can allow for the most effective use of resources to reduce waste to a larger degree than would otherwise be accomplished. For example, based on the results of the characterization, certain relatively highly contaminated surfaces or materials can be targeted for multiple rounds of treatment 102, 104. In another example, radiological contamination of soil waste can be characterized before the consolidating 106 step.

The method 100 can comprise at least one of pyrolyzing waste and incinerating waste. For example, at least one of Class B, Class C, and Intermediate Level Waste can be incinerated and/or pyrolyzed. Incineration of waste can comprise burning waste under oxidizing conditions. A portion of the waste can be oxidized and released as non-radioactive combustion gases, while radioactive ash, soot, and the like can be filtered out of the gases and/or otherwise collected and disposed of. Pyrolyzing waste can comprise heating waste to induce chemical decomposition in an inert atmosphere. Decomposition products can be sorted (e.g., removal of non-radioactive gases or other decomposition products) and radioactive material can be collected and disposed of. Thus, pyrolyzing waste and/or incinerating waste can contribute to reduction of waste by allowing for non-radioactive portions of waste to be chemically separated from radioactive portions. Waste that has been treated 102, 104 and/or consolidated 106 can be pyrolyzed and/or incinerated.

The method 100 can comprise consolidating 106 soil waste. Soil waste can be present, for example, at a nuclear facility undergoing a D&D process. The soil waste may be generated, for example, by mobilized waste which has been stored and/or generated at the facility and has contacted the soil over time. Consolidating 106 soil waste can comprise sorting the soil waste based on at least one of the type of radioactive contamination present and the amount of contamination present. Thus, un-contaminated soil and/or minimally contaminated soil (e.g., soil contaminated below a given threshold) can be disposed of with minimal cost or retained on site, while the remaining portions can be disposed of as reduced radiologically-contaminated waste.

Any sorting technology suitable to sort and/or consolidate contaminated soil can be used in the method 100. For example, the sorting technology can comprise real-time scanning technology. The real-time scanning technology can comprise a radiation detector configured to measure radioactivity of waste and a conveyor belt system configured to separate waste based on the measured radioactivity. For example, the real-time scanning technology can comprise a trommel to sort contaminated soil by size and a first conveyor belt configured to bring contaminated soil from the trommel to a radiation detector. The radiation detector can comprise at least one of a gamma ray spectrometer, an ion chamber survey meter, a Geiger counter, and any other device suitable to detect and/or quantify radiation from the waste. If employed, the gamma ray spectrometer can comprise at least one sodium iodide (NaI) scintillation counter. The radiation detector can be in electronic communication with a computer configured to alter the path of the waste on the conveyor belt system based on the amount and/or nature of radioactivity detected in the waste. For example, waste comprising radioactivity above a contamination threshold can exit the conveyor belt system via a first path and waste comprising radioactivity below the contamination threshold can exit the conveyor belt system via a second path, thereby sorting and consolidating the waste. Thus, only soil waste above the contamination threshold need be disposed of, while other waste may be retained at the nuclear facility, thereby further reducing radioactive waste. Examples of such real-time scanning technology include the Orion ScanSort$^{SM}$ technology available from John Wood Group plc, Aberdeen, Scotland, UK.

The real-time scanning technology can be used to consolidate and/or sort contaminated soil as described above. Alternatively or additionally, the real-time scanning technology can be used to classify, sort, and/or consolidate other types of waste, such as materials and components of the nuclear facility treated in steps 102 and 104 of the method 100. In these examples, the waste may be crushed, shredded, pyrolized, incinerated, or otherwise reduced in size prior to being sorted and/or consolidated by the real-time scanning technology. Thus, only waste above a contamination threshold need be disposed of as controlled radioactive waste of the corresponding class, while other waste may be retained at the nuclear facility or disposed of via alternative, less expensive routes, thereby further reducing radioactive waste.

Once waste has been reduced using the methods disclosed herein, the remaining waste can be disposed of via routes that are consistent with relevant safety guidelines and regulations for disposing of and/or storing radiologically-contaminated waste. Various locations and facilities have been established for disposal of radiologically-contaminated waste, based on the contamination threshold and class of the waste. Class B and C waste (or Intermediate level waste) can be disposed of by Waste Control Specialists (WCS) in Andrews Tex. Class A waste (or LLW) can be disposed of by WCS and Energy Solutions (ES) in Clive, Utah. Exempt waste (or VLLW), can be disposed of by WCS, ES and US Ecology in Boise, Id.

Thus, waste can be disposed of via at least one of different disposal routes, based at least in part on the classification of the waste. Because the methods disclosed herein can reduce waste volume and/or class, smaller amounts of waste can be disposed of via the more expensive and complex routes and larger amounts of waste can be disposed of via the less expensive and complex routes than would otherwise be achievable.

Figure 2:
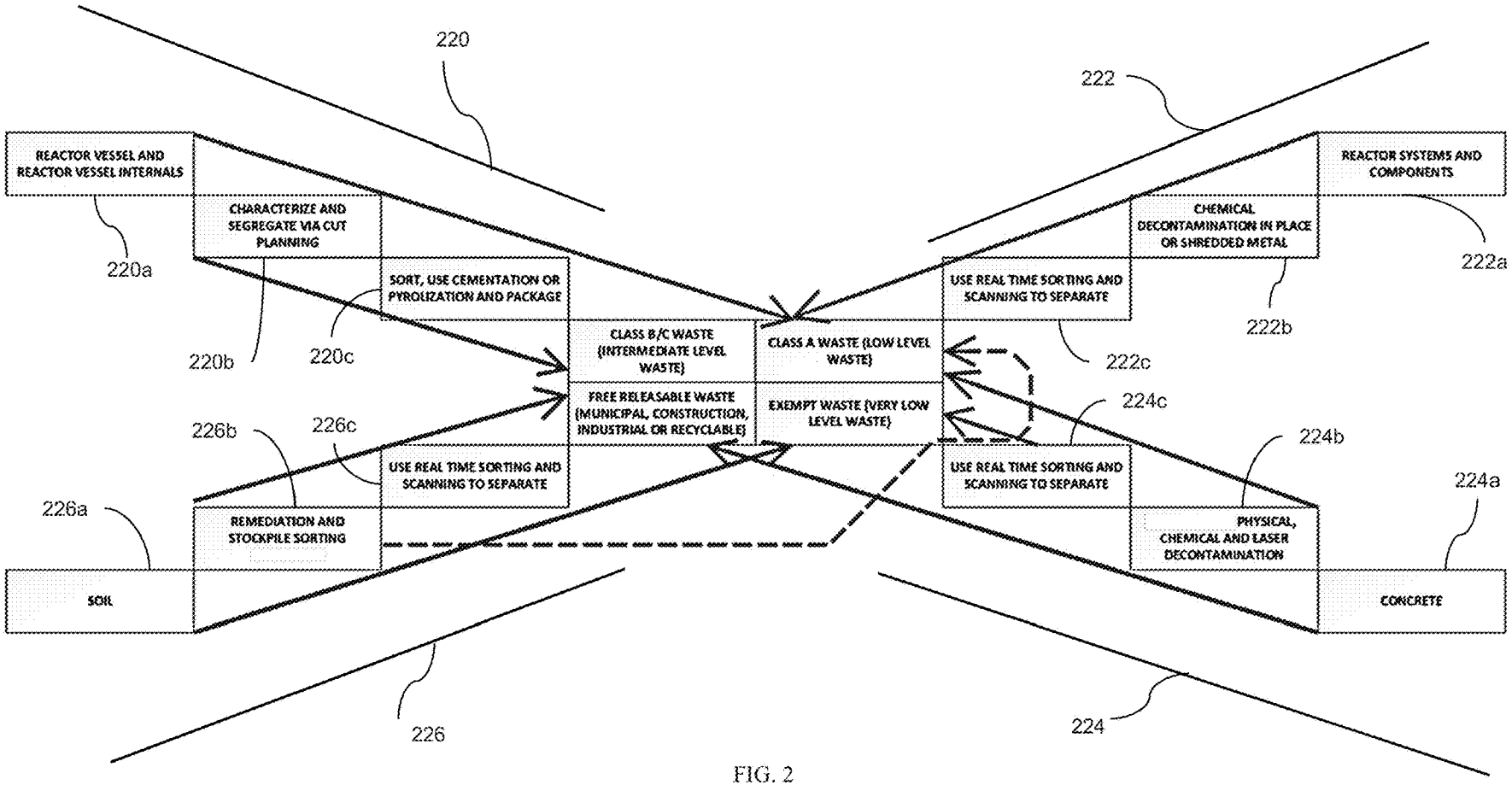
FIG. 2 is a flow chart showing multiple examples of the present disclosure.

All waste to be reduced by the method 100 need not be subjected to all of the steps of the method 100. For example, not all waste from a contaminated structure need be subjected to both the treatment 102 and 104 steps. Treatment steps 102 and 104 may be used alone or in combination on waste, based on chemical compatibility and/or the relative effectiveness of the two treatments 102, 104. Additionally, it is not likely that cementation, incineration, pyrolization, and other options disclosed herein will be applied to all waste. Multiple examples of the reduction of different types of waste, all by different aspects of the method 100, are shown in FIG. 2. The method 100 allows for the integrated treatment of these various types of waste, to increase the ability to reduce waste and dispose of waste efficiently.

Referring to FIG. 1 and FIG. 2, an exemplary reduction of waste from reactor vessels and/or reactor internals 220*a* is indicated by pathway 220. Pathway 220 can comprise characterizing 220*b* levels of radiological contamination of waste as disclosed herein. Performing the characterizing before at least one of the treating 102, 104 and consolidating 106 steps can allow the subsequent steps to focus on an area or subset of waste most in need of treatment and consolidation. As indicated, characterizing 220*b* the waste based on levels of contamination can allow for segregation 220*b* of the waste by, for example cutting, shredding, and/or disassembly as disclosed herein.

As disclosed herein, the reactor vessels and/or reactor internals decontamination waste as shown in 220*a* can be cemented and/or pyrolized and packaged for disposal.

As indicated by the arrows proceeding from pathway 220, pathway 220 can be expected to produce Class B and/or Class C waste, along with Class A waste. Thus at least a portion of waste can be reduced from Class B and/or Class C to Class A. Waste may also be reduced from Class B to Class C.

An exemplary reduction of waste from reactor systems and components 222*a* is indicated by pathway 222. Pathway 222 can comprise treatments such as the treatment 102 during the chemical decontamination 222*b* of reactor systems and components 222*a*. Before or after the decontamination 222*b*, shredding 222*b* of waste may also be employed. Combining the decontamination and shredding of 222*b* can allow for the reduction of waste as disclosed herein.

After the 222*b* step, step 222*c* may be employed. Step 222*c* can comprise use of real-time scanning technology as disclosed herein. As disclosed herein, the real-time scanning technology can be used to classify, sort, and/or consolidate of waste, such as materials and components of a nuclear facility treated in step 102 of the method 100.

As indicated by the arrows proceeding from pathway 222, pathway 222 can be expected to produce chiefly Class A waste. Thus, at least a portion of waste can be reduced from Class B and/or Class C to Class A. Waste may also be reduced to lower classes (e.g., exempt waste) (not shown).

An exemplary reduction of waste from materials in need of subsurface decontamination (e.g., concrete and other materials disclosed herein) 224*a* is indicated by pathway 224. Pathway 224 can comprise step 224*b* comprising physical, chemical, and laser decontamination of materials in need of subsurface decontamination 224*a*. Steps 102 and/or 104 of the method 100 may be performed to decontaminate the waste 224*a* during step 224*b*.

After the 224*b* step, step 224*c* may be employed. Step 224*c* can comprise use of real-time scanning technology as disclosed herein. As disclosed herein, the real-time scanning technology can be used to classify, sort, and/or consolidate waste, such as materials and components of a nuclear facility treated in step 102, 104 of the method 100.

As indicated by the arrows proceeding from pathway 224, pathway 224 can be expected to produce a range of classes of waste. Some material may comprise little or no contamination and be able to be freely released for uncontrolled disposal. Use of the real-time scanning technology during 224*c* may also allow for the separation of Class A and exempt waste, further reducing waste class.

An exemplary reduction of soil waste 226*a* is indicated by pathway 226. Pathway 226 can comprise step 226*b* comprising remediation and sorting of contaminated soil 226*a*. For example, this step can include can comprise the methods for characterizing levels of radiological contamination of waste disclosed herein. Additionally, soil may be sorted manually based on the results of the characterizations to generate initial collections of soil for subsequent separation with real-time scanning technology.

After the 226*b* step, step 226*c* may be employed. Step 226*c* can comprise use of real-time scanning technology as disclosed herein. As disclosed herein, the real-time scanning technology can be used to classify, sort, and/or consolidate soil waste.

As indicated by the arrows proceeding from pathway 226, pathway 226 can be expected to produce a range of classes of waste. Use of the real-time scanning technology 226*c* and manual sorting and remediation 226*b* may allow for the separation of Class A, exempt waste, and freely releasable waste.

Various aspects of the subject matter described herein are set out in the following examples.

Example 1—A method for reducing radiologically-contaminated waste, the method comprising:

treating radiologically-contaminated surfaces, wherein the radiologically-contaminated surfaces are treated with a surface treatment agent;

treating radiologically-contaminated subsurfaces, wherein the radiologically-contaminated subsurfaces are treated with a surface/subsurface treatment agent;

consolidating soil waste;

employing real-time scanning technology to classify waste, wherein the classifying is based at least in part on a threshold of radiological contamination, and wherein the classified waste is sorted based on the classification; and disposing of the waste via at least one of different disposal routes, based at least in part on the classification.

Example 2—The method of claim 1, wherein the method results in a reduction of waste class comprising a reduction of radiologically-contaminated waste from a first contamination threshold to a second, lower contamination threshold.

Example 3—The method of example 2, wherein disposing of the reduced radiologically-contaminated waste comprises disposing via a disposal route that corresponds to the reduced waste class.

Example 4—The method of any one of examples 1-3, further comprising at least one of pyrolyzing waste and incinerating waste.

Example 5—The method of any one of examples 1-4, further comprising characterizing levels of radiological contamination of waste before the treating and consolidating steps.

Example 6—The method of any one of examples 1-5, wherein the real-time scanning technology is employed to consolidate soil waste during the consolidating step.

Example 7—The method of example 6, wherein the real-time scanning technology comprises:

a radiation detector configured to measure radioactivity of waste and a conveyor belt system configured to separate waste based on the measured radioactivity.

Example 8—The method of example 7, further comprising employing the real-time scanning technology to at least one of classify and consolidate non-soil waste that was treated in at least one of the treatment steps.

Example 9—The method of any one of examples 1-8, wherein treating radiologically-contaminated surfaces comprises disassembling components and treating the components in a bath.

Example 10—The method of any one of examples 1-9, further comprising at least one of shredding and crushing waste.

Example 11—The method of any one of examples 1-10, wherein at least one of the surface/subsurface treatment agent and the surface treatment agent are applied via an automated process.

Example 12—The method of any one of examples 1-11, wherein at least one of the surface/subsurface treatment agent and the surface treatment agent comprise at least one of a salt, a surfactant, an acid, a chelator, a wetting agent, and an absorbent gel.

Example 13—The method of any one of examples 1-12, further comprising cementing at least one of liquid and solid waste.

Example 14—A method for reducing radiologically-contaminated waste, the method comprising:

treating radiologically-contaminated surfaces, wherein the radiologically-contaminated surfaces are treated with a surface treatment agent;

treating radiologically-contaminated subsurfaces, wherein the radiologically-contaminated subsurfaces are treated with a surface/subsurface treatment agent;

consolidating soil waste;

employing real-time scanning technology to classify waste, wherein the classifying is based at least in part on a threshold of radiological contamination, and wherein the classified waste is sorted based on the classification; and disposing of the waste via at least one of different disposal routes, based at least in part on the classification, wherein the method results in a reduction of waste class comprising a reduction of radiologically-contaminated waste from a first contamination threshold to a second lower contamination threshold, and wherein disposing of the reduced radiologically-contaminated waste comprises disposing via a disposal route that corresponds to the reduced waste class.

Example 15—The method of example 14, further comprising at least one of pyrolyzing waste and incinerating waste.

Example 16—The method of example 14 or 15, further comprising characterizing levels of radiological contamination of waste before the treating and consolidating steps.

Example 17—The method of any one of examples 14-16, wherein the real-time scanning technology comprises:

a radiation detector configured to measure radioactivity of waste and a conveyor belt system configured to separate waste based on the measured radioactivity.

Example 18—The method of one of examples 14-17, wherein treating radiologically-contaminated surfaces comprises disassembling components and treating the components in a bath.

Example 19—The method of any one of examples 14-18, further comprising at least one of shredding and crushing waste.

Example 20—The method of any one of examples 14-19, further comprising cementing at least one of liquid and solid waste.

Unless specifically stated otherwise as apparent from the foregoing disclosure, it is appreciated that, throughout the foregoing disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A method for reducing radiologically-contaminated waste, the method comprising:

treating radiologically-contaminated surfaces, wherein the radiologically-contaminated surfaces are treated with a surface treatment agent;

treating radiologically-contaminated subsurfaces, wherein the radiologically-contaminated subsurfaces are treated with a surface/subsurface treatment agent;

consolidating soil waste;

employing real-time scanning technology to classify waste based at least in part on a threshold of radiological contamination;

sorting the waste based on a classification produced from the employing the real-time scanning technology to classify waste;

disposing of the waste via at least one of different disposal routes, based at least in part on the classification; and at least one of pyrolyzing and incinerating at least a portion of the waste.

2. The method of claim 1, wherein a reduction of radiologically-contaminated waste from a first contamination threshold to a second, lower contamination threshold occurs.

3. The method of claim 2, wherein disposing of the waste comprises disposing via a disposal route that corresponds to the second, lower contamination threshold waste class.

4. The method of claim 1, further comprising characterizing levels of radiological contamination of waste before the treating and consolidating steps.

5. The method of claim 1, wherein the real-time scanning technology is employed to consolidate soil waste during the consolidating soil waste.

6. The method of claim 5, wherein the real-time scanning technology comprises:

a radiation detector configured to measure radioactivity of waste and a conveyor belt system configured to separate waste based on a measured radioactivity.

7. The method of claim 6, further comprising employing the real-time scanning technology to at least one of classify and consolidate non-soil waste that was treated in at least one of the treating radiologically-contaminated surfaces and the treating radiologically-contaminated subsurfaces.

8. The method of claim 1, wherein treating radiologically-contaminated surfaces comprises disassembling components and treating the components in a bath.

9. The method of claim 1, further comprising at least one of shredding and crushing waste.

10. The method of claim 1, wherein at least one of the surface/subsurface treatment agent and the surface treatment agent are applied via an automated process.

11. The method of claim 1, wherein at least one of the surface/subsurface treatment agent and the surface treatment agent comprises at least one of a salt, a surfactant, an acid, a chelator, a wetting agent, and an absorbent gel.

12. The method of claim 1, further comprising cementing at least one of liquid and solid waste.

13. A method for reducing radiologically-contaminated waste, the method comprising:

treating radiologically-contaminated surfaces, wherein the radiologically-contaminated surfaces are treated with a surface treatment agent, wherein treating radiologically-contaminated surfaces comprises disassembling components and treating the components in a bath;

treating radiologically-contaminated subsurfaces, wherein the radiologically-contaminated subsurfaces are treated with a surface/subsurface treatment agent;

consolidating soil waste;

employing real-time scanning technology to classify waste based at least in part on a threshold of radiological contamination;

sorting the waste based on a classification produced by the employing real-time scanning technology to classify waste; and disposing of the waste via at least one of different disposal routes, based at least in part on the classification, wherein a reduction of radiologically-contaminated waste from a first contamination threshold to a second lower contamination threshold occurs, and wherein disposing of the waste comprises disposing via a disposal route that corresponds to the second lower contamination threshold.

14. The method of claim 13, further comprising at least one of pyrolyzing waste and incinerating waste.

15. The method of claim 13, further comprising characterizing levels of radiological contamination of waste before the treating radiologically-contaminated surfaces, the treating, treating radiologically-contaminated subsurfaces and the consolidating the soil waste.

16. The method of claim 13, wherein the real-time scanning technology comprises:

a radiation detector configured to measure radioactivity of waste and a conveyor belt system configured to separate waste based on a measured radioactivity.

17. The method of claim 13, further comprising at least one of shredding and crushing waste.

18. The method of claim 13, further comprising cementing at least one of liquid and solid waste.

* * * * *